US006427788B1

(12) United States Patent
Rauchenstein

(10) Patent No.: US 6,427,788 B1
(45) Date of Patent: Aug. 6, 2002

(54) UNDERREAMING ROTARY DRILL

(75) Inventor: William D. Rauchenstein, Arlington, TX (US)

(73) Assignee: Emerald Tools, Inc., Arlington, TX (US)

( * ) Notice: Subject to any disclaimer, the term of this patent is extended or adjusted under 35 U.S.C. 154(b) by 5 days.

(21) Appl. No.: 09/668,613

(22) Filed: Sep. 22, 2000

(51) Int. Cl.[7] ..... E21B 10/26; E21B 10/32; E21B 23/08

(52) U.S. Cl. ..... 175/269; 175/266; 175/271; 166/383

(58) Field of Search ..... 175/263, 274, 175/271, 266, 291, 267, 269, 289; 166/381, 383

(56) References Cited

U.S. PATENT DOCUMENTS

| | | | | |
|---|---|---|---|---|
| 1,478,306 A | | 12/1923 | Sweetman | |
| 1,667,155 A | | 4/1928 | Higdon | |
| 2,124,663 A | | 7/1938 | Wintemute | |
| 2,344,598 A | | 3/1944 | Church | |
| 2,466,991 A | * | 4/1949 | Krammer | 175/271 |
| 2,705,129 A | * | 3/1955 | Menton et al. | 175/263 |
| 2,756,968 A | | 7/1956 | Emanuel et al. | |
| 2,799,477 A | * | 7/1957 | Krammer, Jr. | 175/271 |
| 2,872,160 A | | 2/1959 | Barg | |
| 3,208,540 A | | 9/1965 | Park | |
| 3,548,362 A | | 12/1970 | Blank, Jr. | |
| 3,552,510 A | * | 1/1971 | Brown | 175/261 |
| 3,656,564 A | * | 4/1972 | Brown | 175/228 |
| 3,712,854 A | * | 1/1973 | Thometz et al. | 175/269 |
| 3,749,187 A | * | 7/1973 | Leathers | 175/269 |
| 4,031,972 A | | 6/1977 | Burg | |
| 4,116,012 A | | 9/1978 | Abe et al. | |
| 4,354,560 A | | 10/1982 | Johnson | |
| 4,401,171 A | * | 8/1983 | Fuchs | 175/267 |
| 4,431,065 A | | 2/1984 | Andrews | |
| 4,461,361 A | * | 7/1984 | Fuchs | 175/269 |
| 4,470,470 A | * | 9/1984 | Takano | 175/260 |
| 4,565,252 A | * | 1/1986 | Campbell et al. | 175/269 |
| 5,010,955 A | | 4/1991 | Springer | |
| 5,141,063 A | * | 8/1992 | Quesenbury | 175/267 |
| 5,148,875 A | | 9/1992 | Karlsson et al. | |
| 5,201,817 A | * | 4/1993 | Hailey | 175/269 |
| 5,385,205 A | * | 1/1995 | Hailey | 166/55.8 |
| 5,402,856 A | | 4/1995 | Warren et al. | |
| 6,009,961 A | * | 1/2000 | Pietrobelli et al. | 175/269 |
| 6,070,677 A | * | 6/2000 | Johnston, Jr. | 175/57 |

* cited by examiner

*Primary Examiner*—David Bagnell
*Assistant Examiner*—Jennifer H Gay
(74) *Attorney, Agent, or Firm*—Harness, Dickey, & Pierce, P.L.C.

(57) ABSTRACT

A drilling apparatus for underreaming includes a top sub, a pressure sleeve mated to the top sub, and a blade body mated to the pressure sleeve. A pilot bit is mated to the lower end of the blade body. A plurality of movable cutting blades are pivotably attached to the blade body by pivot pins. Each of the pins is inserted through the blade body and the cutting blade. Slidable covers, held in place by the pressure sleeve, are used to retain the pins. A mandrel is centrally positioned with respect to the pressure sleeve and the blade body and is axially movable therein. Each of the cutting blades includes an end which is operatively associated with channels transversely formed on one end of the mandrel. Movement of the mandrel in a first axial direction effects retraction of the cutting blades. Movement of the mandrel in a second axial direction effects extension of the cutting blades. The mandrel is held in its blade-retracting position by the biasing force of a spring. A build-up of hydraulic fluid, selectively delivered from the operator, in a pressure chamber formed between the pressure sleeve and the mandrel causes the mandrel to be moved to its blade-extending position when a critical mass of fluid pressure is achieved.

28 Claims, 7 Drawing Sheets

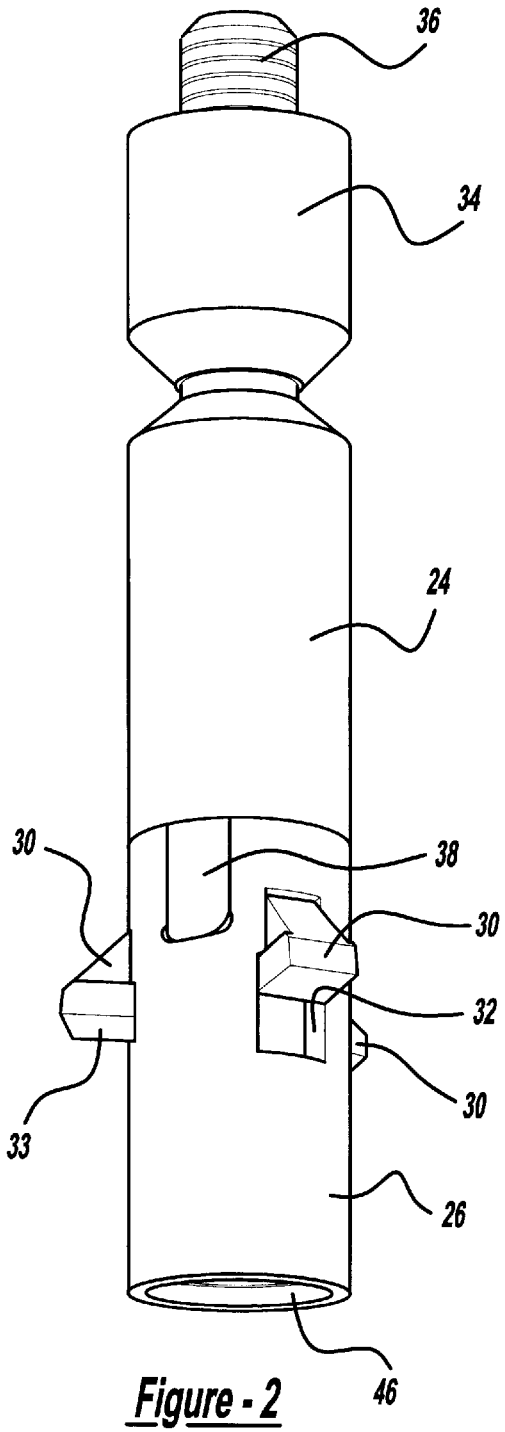
Figure - 2
Figure - 5
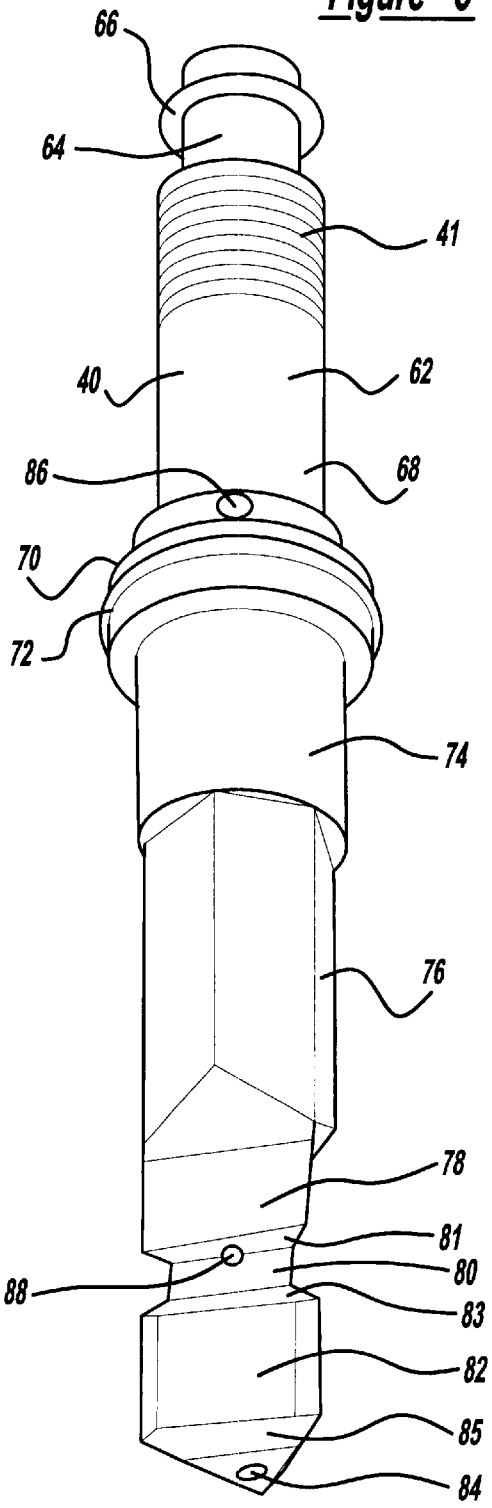

UNDERREAMING ROTARY DRILL

BACKGROUND OF THE INVENTION

1. Technical Field

The present invention relates generally to a rotary drill for use in drilling. More particularly, the present invention relates to an earth drilling apparatus having extendable cutting blades for cutting or underreaming.

2. Summary of Related Art

Well drilling operations frequently require that the area being drilled be expanded at selected points. In many instances, where a pipe casing or lining is in place, the pipe requires clearing of debris or other material from deep inside the well. In each of these situations a special type of drill known as an underreamer is required.

Underreaming drills allow for the widening of a selected area in a well. In general, an underreaming drill includes a pilot bit portion and an underreaming tool attached upstream from the pilot bit portion. The underreaming tool includes plurality of cutting blades that are movable as a group between a retracted position and an extended position. In their retracted position, the blades are folded into the body of the underreaming tool, thus allowing insertion and extraction of the tool from the area being worked. In their extended position, the blades are pivoted to a position which is substantially perpendicular to the long axis of the tool. While extended, the blades are able to underream an area thus enlarging the region for a given purpose.

While the general object of blade retraction and extension has been achieved by many tools, movement of the blades has been effected by a variety of mechanisms. For example, underreamers which include rack-and-pinion like gear and driver arrangements are disclosed in U.S. Pat. No. 5,402,856 issued to Warren et al. on Apr. 4, 1995, for ANTI-WHIRL UNDERREAMER, U.S. Pat. No. 3,208,540 issued to Park on Sep. 28, 1965, for EXPANSIBLE ROTARY WELL DRILLING BIT, U.S. Pat. No. 2,872,160 issued to Barg on Feb. 3, 1959, for HYDRAULIC EXPANSIBLE ROTARY WELL DRILLING BIT, and U.S. Pat. No. 1,478,306 issued to Sweetman on Dec. 18, 1923, for UNDERREAMER. In general, in each of these patents one set of teeth are formed on a curved end-surface of each blade, while another set of teeth are formed on an axially-movable driver assembly. The blades are pivotably attached to the hollow drill body.

U.S. Pat. No. 4,431,065 issued to Andrews on Feb. 14, 1984, for UNDERREAMER and U.S. Pat. No. 5,010,955 issued to Springer on Apr. 30, 1991, for CASING MILL AND METHOD teach a gear arrangement similar to the patents mentioned immediately above, but further include a stop arrangement for halting the outward pivoting of the blades. While such a stop is arguably inherent in the patents mentioned immediately above, the arrangement is more positively defined in these latter patents.

Additional variations may be seen in U.S. Pat. No. 4,116,012, issued to Abe et al. on Sep. 26, 1978, for METHOD OF OBTAINING SUFFICIENT SUPPORTING FORCE FOR A CONCRETE PILE SUNK INTO A HOLE, U.S. Pat. No. 3,548,362, issued to Blank, Jr. on Dec. 15, 1970, for WELL CASING CONTACT TOOL, U.S. Pat. No. 2,756,968, issued to Emanuel et al. on Jul. 31, 1956, for EXPANSIBLE WELL SCRAPER, U.S. Pat. No. 2,124,663, issued to Wintemute on Jul. 26, 1938, for ROTARY UNDERREAMER, and U.S. Pat. No. 1,667,155 issued to Higdon on Apr. 24, 1928, for DRILLING BIT, which teach various arrangements of slots alone or slots and driving pins which are engaged to selectively effect outward or inward pivoting movement of cutting blades with respect to the drill shaft for underreaming.

While arguable providing improvements in the art of underreamer drills, the art still suffers from a variety of problems. The environment in which these drills operate causes frequent problems to the underreaming assembly, such as debris entanglement and premature wear. The prior art mechanisms, while perhaps well-engineered, are overly complex and require for too much "down time" for the tool and, hence, the drilling operation. Disassembly and reassembly are difficult and time consuming. Hours are lost when a tool fails and has to be withdrawn, repaired and reinserted.

By way of example, cutting blades of known underreamers are pivotably retained to the assembly by set-screw arrangements. High rotational speed and hard materials frequently cause these screws to break, thus allowing parts of the tool to drop into the well, requiring removal of the tool and an extensive fishing expedition to recover the dropped parts. The heads of the set screws themselves, being externally exposed, are subject to wear, further complicating disassembly and reassembly.

In addition, known drilling apparatus frequently suffer from premature wear on not only the drilling assembly but also on the connection between the cutting blades and the body of the underreamer due to the tortional force being concentrated at the connection where the cutting blades are extended.

Accordingly, a simple yet effective underreaming apparatus remains wanting.

SUMMARY OF THE INVENTION

It is the general object of the present invention to provide an underreaming assembly to overcome the problems of the prior art.

More particularly, it is an object of the present invention to provide an underreaming apparatus which is relatively easy to operate and which provides for minimal operational "down time."

It is a further object of the present invention to provide such an apparatus which may be readily disassembled and reassembled for changing the cutting blades.

Still an additional object of the present invention is to provide such an apparatus which has a minimal number of parts and threaded elements.

A further object is to provide a dynamic fluid chamber that is able to axially drive a mandrel on the build-up of a selected fluid pressure to effect extension of the cutting blades, thereby providing an efficient and positive engagement mechanism.

An additional object of the present invention is to provide such an apparatus which is capable of transferring torque to the entire underreaming when the cutting blades are extended.

These and other objects are accomplished by the provision of a drilling apparatus having extendable cutting blades for cutting or underreaming. The drilling apparatus of the present invention includes a top sub, a pressure sleeve mated to the top sub, and a blade body mated to the pressure sleeve. A pilot bit is mated to the lower end of the blade body. A plurality of movable cutting blades are pivotably attached to the blade body by pivot pins. Each of the pins is inserted through the blade body and the cutting blade. Slidable covers, held in place by the pressure sleeve, are used to retain the pins. A mandrel is centrally positioned with respect to the pressure sleeve and the blade body and is axially movable therein. Each of the cutting blades includes an end which is operatively associated with channels transversely formed on one end of the mandrel.

Movement of the mandrel in a first axial direction effects retraction of the cutting blades. Movement of the mandrel in a second axial direction effects extension of the cutting blades. The mandrel is held in its blade-retracting position by the biasing force of a spring. A build-up of hydraulic fluid, selectively delivered from the operator, in a pressure chamber formed between the pressure sleeve and the mandrel causes the mandrel to be moved to its blade-extending position when a critical mass of fluid pressure is achieved.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which:

FIG. 2 is perspective view of the drilling apparatus of the present invention, including the top sub, the pressure sleeve, and the blade body;

FIG. 5 is a perspective view of the mandrel of the drilling apparatus;

DETAILED DESCRIPTION OF THE PREFERRED EMBODIMENT

The drawings disclose the preferred embodiment of the present invention.

While the configurations according to the illustrated embodiment are preferred, it is envisioned that alternate configurations of the present invention may be adopted without deviating from the invention as portrayed. The preferred embodiment is discussed hereafter.

Figure 1:
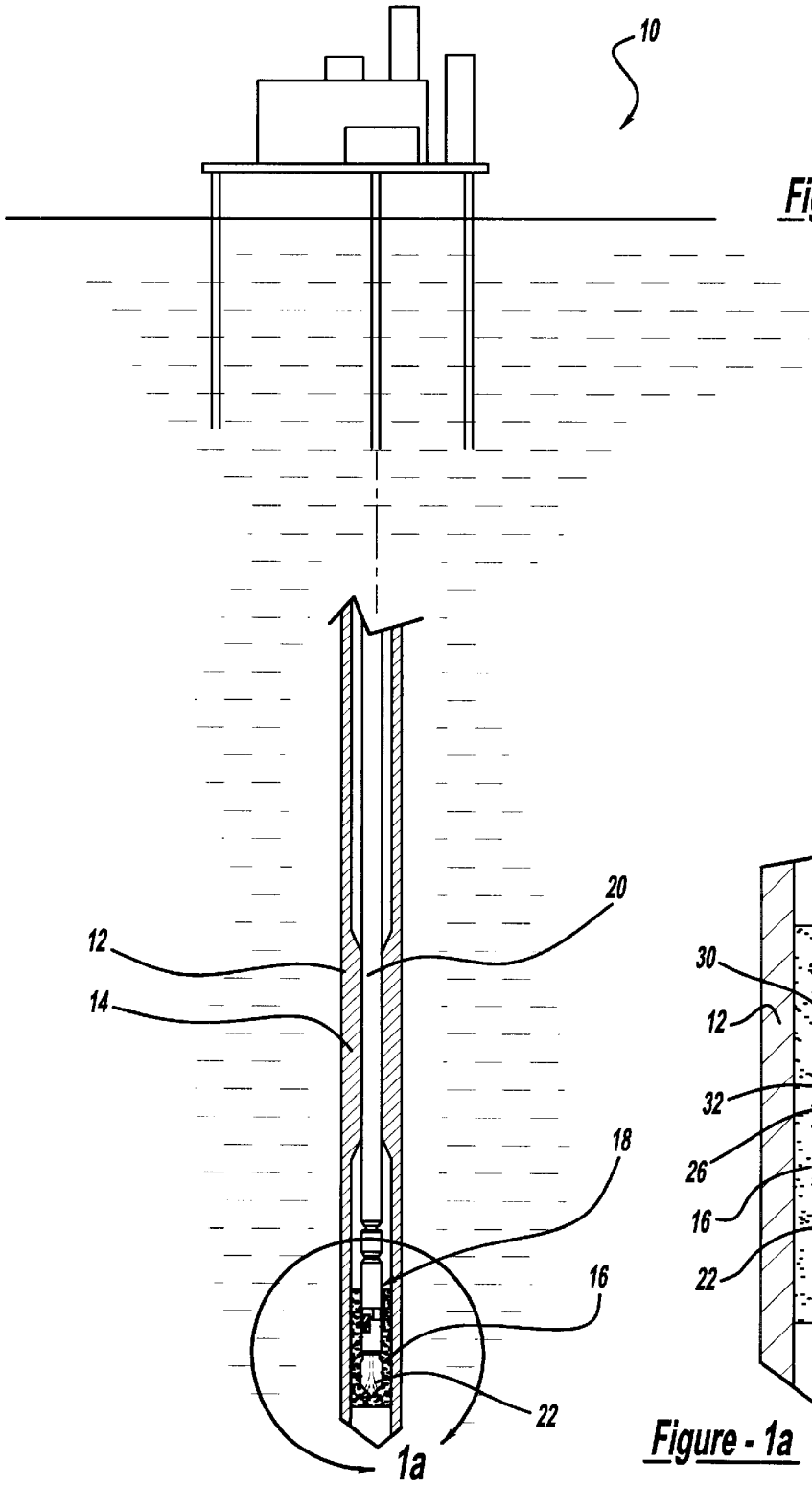
FIG. 1 is an environmental view of the drilling apparatus of the present invention shown relative to a drilling operation platform.

The drilling apparatus of the present invention may find applications in a variety of operations. For example, the apparatus may find utility in many drilling applications including well drilling, boring, and coring operations. However, the present invention finds particular application in the removal of obstructions from piping, as generally illustrated in FIG. 1. Furthermore, operations may be on dry ground or, as illustrated in FIG. 1, on ocean-bound derricks or rigs.

With reference to FIG. 1, a drilling rig, generally illustrated as 10, is positioned roughly over an existing pipe or well 12. The well 12 has one or more integral narrowed regions, generally illustrated as 14. As may be understood by reference to the figure, the regions 14 act to restrict passage of a bit and limit the bit's outer diameter.

Occasionally obstructions appear in one or more ares of the well 12. Such obstructions may be composed of a variety of materials, but typically include paraffin, rock, or shale. Sometimes the obstruction is intentionally placed during the formation of the well 12 so as to halt or limit the unwanted flow of fluids into or out of the well 12. Such an obstruction is formed by the insertion of, for example, cement into the well at a certain point. Later during well construction the cement will have to be removed to allow the continuation of well construction. In any event, an obstruction is illustrated in FIG. 1 as material 16.

In all such instances it will be necessary for the obstruction, whatever the material or its source, to be cleared to allow proper operation of the well 12. A drill motor with bit and bit extension attached will normally be employed for such purposes. However, in the event that a restriction such as region 14 exists, a bit which can pass the restriction and thereafter be extended to undercut the area is required.

As generally set forth above, the drilling apparatus of the present invention provides a solution to this problem by employing a drilling apparatus, generally illustrated as 18. The apparatus is connected to a drill motor (not illustrated) which is located on or about the drilling rig via an extension shaft 20. As is known in the art, the length of the extension shaft may be lengthened at intervals during the drilling process by adding more individual shaft elements (drill pipe). This procedure is reversed to remove the drilling apparatus 18, also as is known in the art. Those skilled in the art will also recognize that continuous milled tubing having various diameters may also be used as opposed to the use of standard drill pipe.

At the lowermost part of the drilling apparatus 18 is removably provided a pilot bit 22. The pilot bit 22 is threadably attached to the drilling apparatus 18 and acts to properly center the drilling apparatus 18 as it enters the material it is drilling.

Figure 1A:
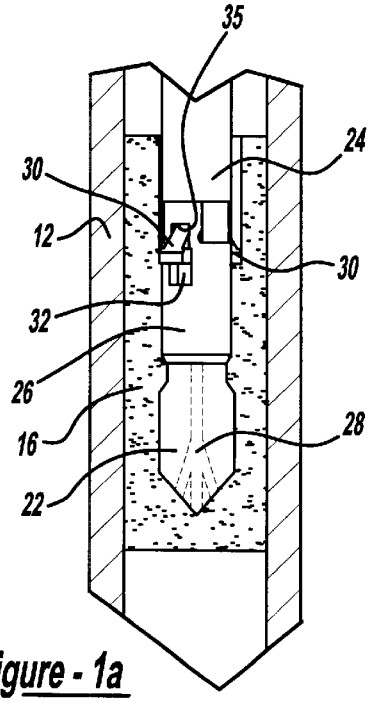
FIG. 1*a* is a view taken along line 1*a* of FIG. 1 which illustrates the operative portion of the drilling apparatus of the present invention in greater detail.

The drilling apparatus 18 and its general environment is illustrated in greater detail in FIG. 1*a* which is a view taken along line 1*a* of FIG. 1. The drilling apparatus 18 includes a pressure sleeve 24 and a blade body 26 which is threadably mated to the pressure sleeve 24, as will be discussed in more detail below. The pilot bit 22 is threadably mated to the lower end of the blade body 26. Defined through the approximate center of the pilot bit 22 and fanning out therefrom are a series of fluid passageways 28 shown in phantom. (The external openings of the fluid passageways 28 are more clearly shown in FIG. 3.) Hydraulic fluid is injected from the approximate area of the motor through the extension shaft 20, through the drilling apparatus 18 as will be described in greater detail below, and through the fluid passageways 28 for lubricating, cutting and cooling purposes.

Underreaming of the obstructed area (or the subject material) is accomplished via the selected extension of a plurality of cutting blades 30 which are illustrated in FIGS. 1 and 1*a* as being extended from the blade body 26. A plurality of slots 32 are formed in the wall of the blade body 26 to receive the cutting blades 30 when in their retracted positions. Each of the slots 32 includes a first cutting blade stop edge 35 and a second angled stop edge 37, which is more clearly shown in FIG. 4 and further described herein. A cutting surface 33 is formed on each of the cutting blades 30. The cutting surface 33 would ordinarily be provided with a cutting material such as carbide (not shown).

In general operation, the cutting blades 30 are in their retracted positions relative to the blade body 26 when the drilling apparatus 18 is inserted into and withdrawn from the well 12. Once having passed the restricted region 14, the cutting blades 30 are extended to open the obstructed area.

FIG. 2 is a perspective view of the drilling apparatus 18. As illustrated in this figure, the drilling apparatus 18 includes the pressure sleeve 24, the blade body 26 and a top sub 34. The top sub 34 is substantially hollow to allow the flow-through of hydraulic fluid, as is known in the art. A threaded end 36 is formed on one end of the top sub 34 for attachment to other shafts to extend the assembly to its desired length.

In addition to providing more detail as to the arrangement and construction of the cutting blades 30 in relation to the blade body 26, FIG. 2 also illustrates a dove-tail cover of pivot pin retaining cover 38. The cover 38 and its functions will be described in further detail as this description proceeds.

Figure 3:
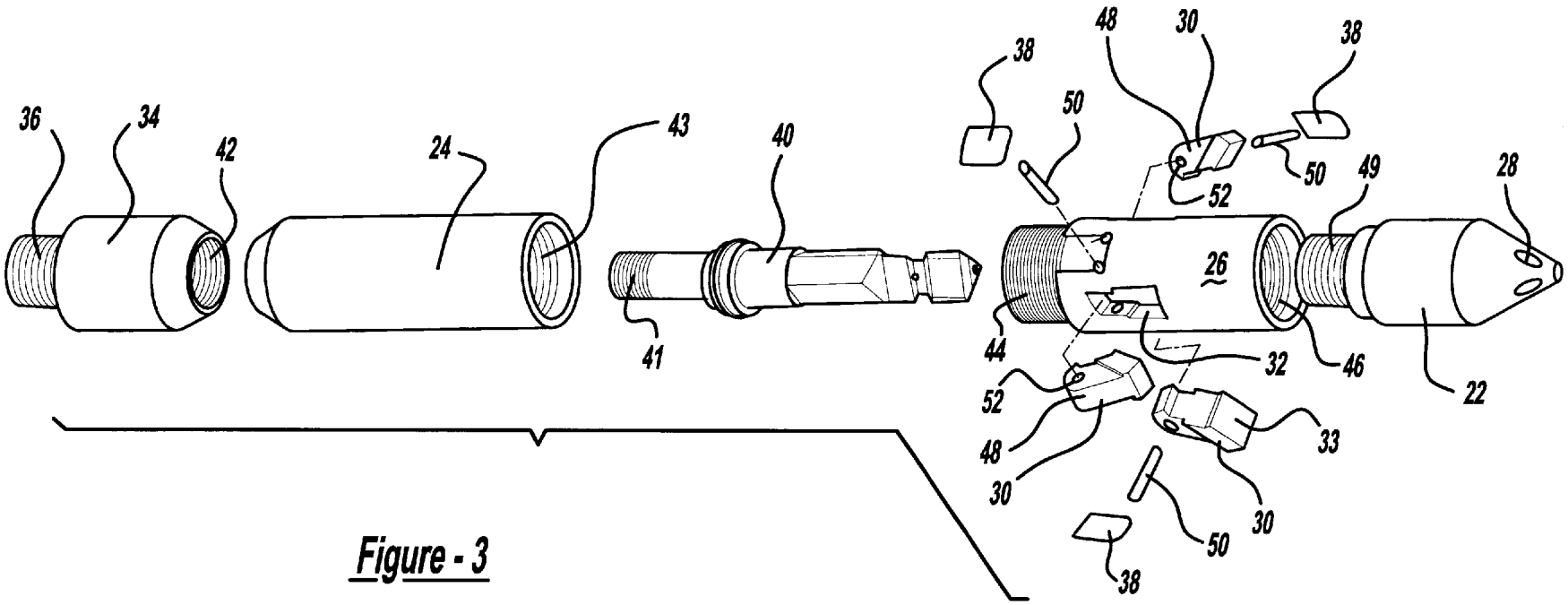
FIG. 3 is an exploded view of the drilling apparatus of the present invention, illustrating internal as well as external components.

FIG. 3 illustrates an exploded view of the drilling apparatus 18 in relation to the pilot bit 22. While the external components of the drilling apparatus 18 have been generally introduced, the primary internal component, a mandrel 40, is shown initially in FIG. 3. The mandrel 40 is movable in both directions along the long axis of the drilling apparatus 18 and includes external threads 41. (Both the pressure sleeve 24 and the blade body 26 are substantially hollow.) It is the movement of the mandrel 40 which effects selective movement of the cutting blades 30 between their extended and retracted positions, as will be discussed in further detail below.

Figure 6:
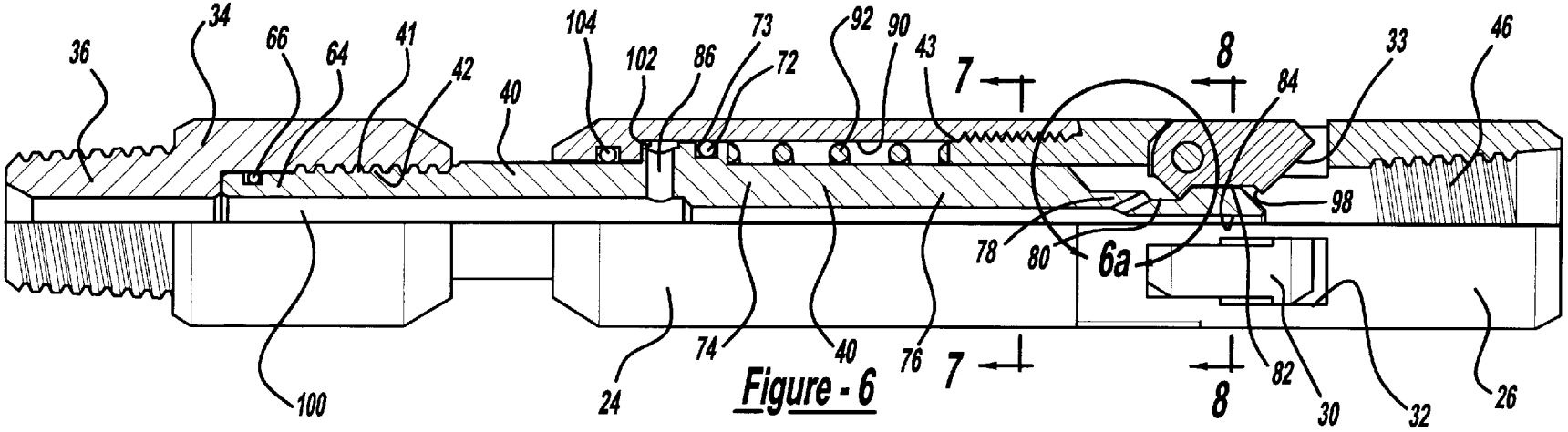
FIG. 6 is a partially-sectioned side view of the drilling apparatus of the present invention with the cutting blades in their retracted positions.
Figure 9A:
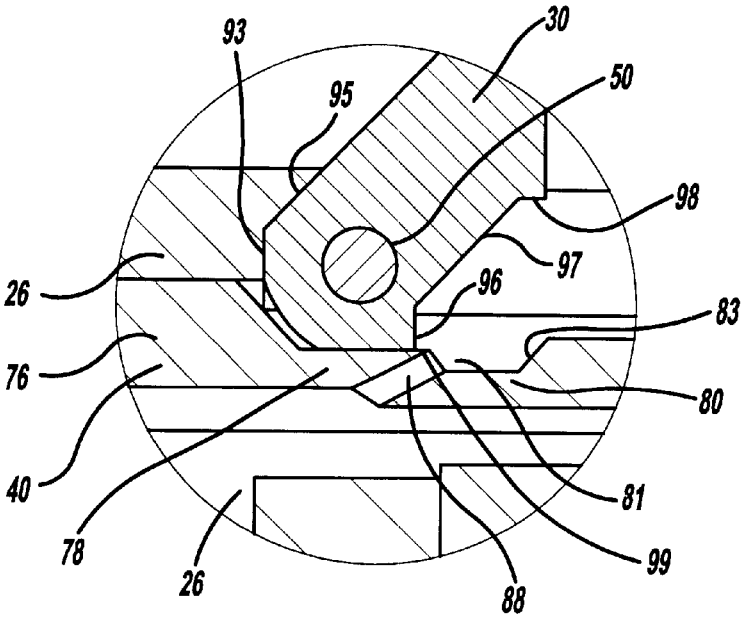
FIG. 9*a* is a view taken along line 9*a* of FIG. 9 which details the arrangement between the mandrel and the extended cutting blade.
Figure 9:
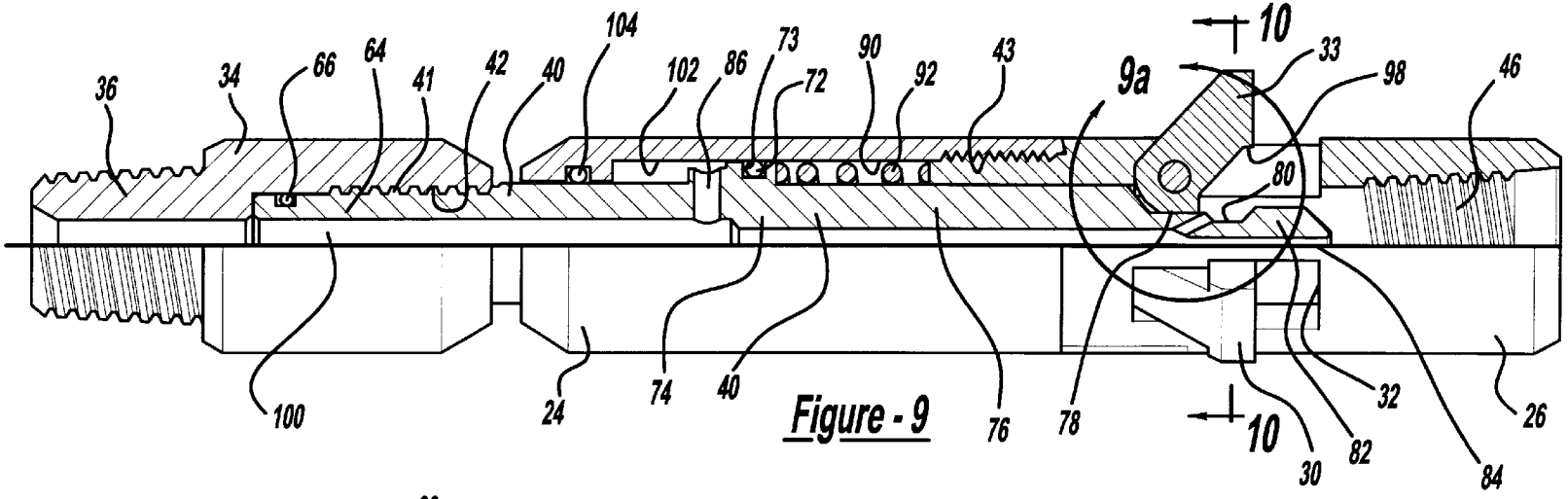
FIG. 9 is a partially-sectioned side view of the drilling apparatus of the present invention with the cutting blades in their extended positions.

The top sub 34 includes a series of internal threads 42 which are matable with the external threads 41 of the mandrel 40 This arrangement allows for selective attachment of the top sub 34 with the mandrel 40, such mated arrangement being best illustrated in FIGS. 6 and 9. The pressure sleeve 24 includes a series of internal threads 43 which are matable with a series of external threads 44 formed at one end of the blade body 26. The threads 44 of the blade body 26 terminate at a shoulder 45 formed on the blade body 26. This arrangement allows for selective attachment of the pressure sleeve 24 with the blade body 26. The blade body 26 has a series of internal threads 46 formed at its opposite end which are matable with a series of external threads 49 formed at one end of the pilot bit 22. This arrangement allows for selective attachment of the blade body 26 with the pilot bit 22.

Figure 4:
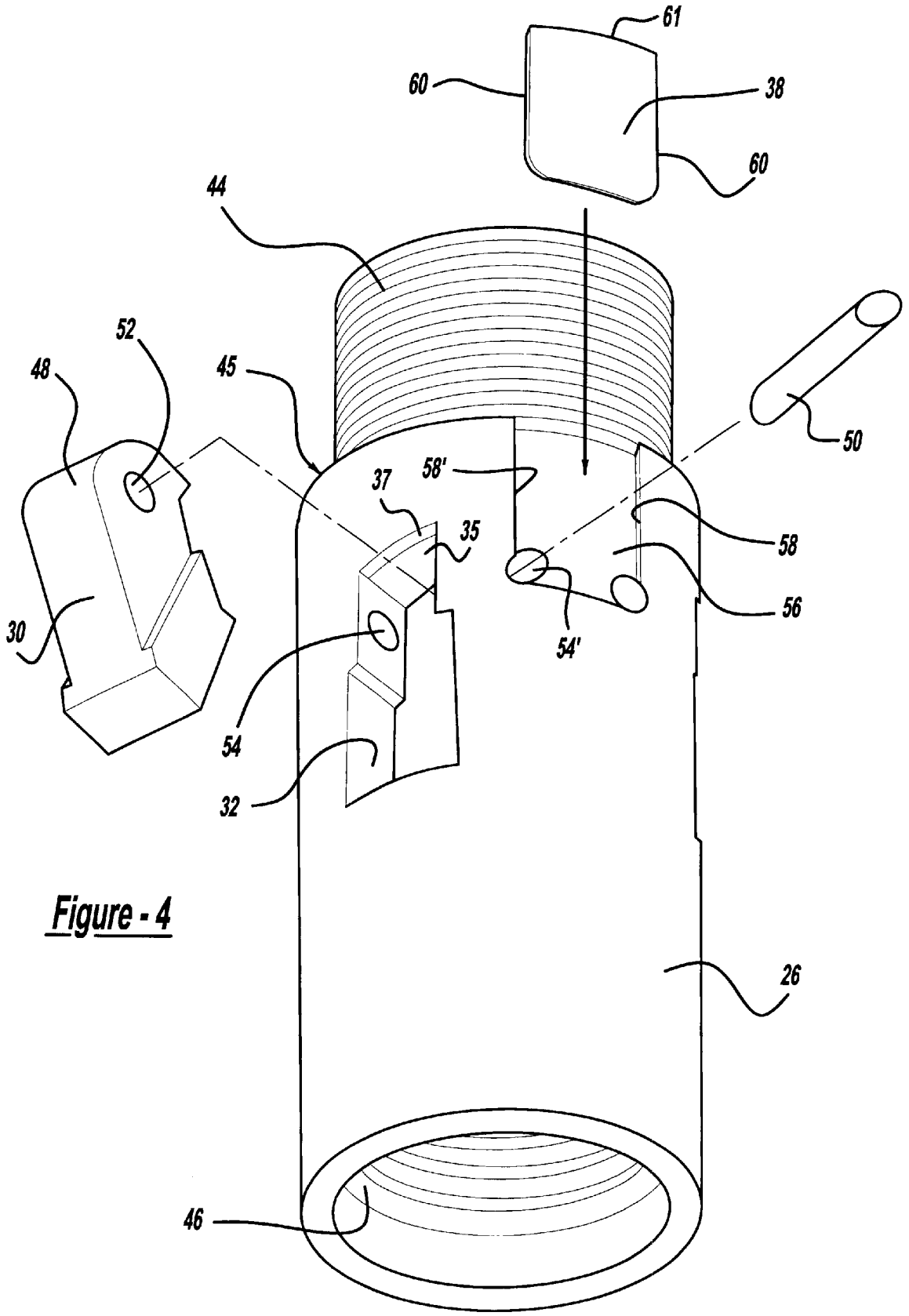
FIG. 4 is an exploded view of the blade body relative to the blade, the blade pin, and the dove-tail cover.

While illustrated in FIG. 3, the construction and arrangement of the blade body 26 and its accompanying cutting blades 30 is more clearly illustrated in FIG. 4. With reference then to FIG. 4, the profile of the cutting blade slot 32 is readily seen. This profile roughly corresponds to the external profile of the illustrated cutting blade 30. Such a configuration having a relatively close tolerance is beneficial in resisting the possible infiltration of debris into the interior of the blade body 26 when the cutting blades 30 are in their retracted positions.

For purposes of the immediate discussion to explain the blade arrangement and to aid in simplicity of understanding, reference will only be made to a single blade arrangement, although each of the three cutting blades 30 are arranged identically. The cutting blade 30 includes a blade body attachment end 48 for pivotable attachment to the blade body 26. The attachment end 48 is pivotably attached to the blade body 26 by a pivot pin 50. The pin 50 is slidably insertable through a channel or bore 52 defined completely through the attachment end 48 of the cutting blade 30. The pin 50 is also slidably insertable through a pair of opposing channels or bores 54, 54' defined through the blade body 26 adjacent to the cutting blade slot 32.

The pivot pin retaining cover 38 is slidably fitted into a pivot pin retaining cover slot 56. A pair of opposed walls 58, 58' are formed on the slot 56 and are bevelled inwardly to mate with a pair of opposed edges 60, 60' formed on the pivot pin retaining cover 38. The walls 58, 58' and the edges 60, 60' mate in a dove-tail configuration, thus allowing only for sliding insertion or sliding removal from the blade body 26 along the external threads 44.

The pivot pin retaining cover 38 is held in place by the pressure sleeve 24 after the latter is threadably fitted to the blade body 26. (The attachment of the pressure sleeve 24 to the blade body 26 is illustrated in FIGS. 2 and 3.) The pivot pin retaining cover 38 includes a pressure sleeve abutment wall 61 which is canted or angled. The leading edge of the pivot pin retaining cover 38 which is defined by the cant or angle extends somewhat beyond the shoulder 45 of the blade body 26. This configuration assures a press fit within the pivot pin retaining cover slot 56 when the pressure sleeve 24 is threadably mated to the blade body 26 by a biasing force.

Because the outer side of the pivot pin retaining cover 38 is generally flush with the outer side of the blade body 26 after insertion and because the tolerances of the walls 58, 58' and the edges 60, 60' are relatively close, debris is substantially kept out of the pivot pin retaining cover slot 56. In addition, the presence of the pivot pin retaining cover 38 eliminates the risk of shearing of the pins 50, thus overcoming a significant problem of the prior art. Furthermore, this arrangement, coupled with the relatively simple means of cover retention as described above, allows for relatively easy disassembly and assembly of the drilling apparatus 18 at such times as it may be necessary to change the cutting blade 30.

To assemble the blade body 26, once the cutting blade 30 is positioned in its cutting blade slot 32 and with the pivot pin retaining cover 38 removed, the pin 50 is inserted through one of the pair of opposing channels 54, 54' to pass through the channel 52, and into the other of the pair of opposing channels 54, 54'. As illustrated, the ends of the pin 50 are bevelled such that, once in its assembled position, the ends lie substantially flush with the floor of the pivot pin retaining cover slot 56. The pivot pin retaining cover 38 is then slid into place into the pivot pin retaining cover slot 56. Once this procedure has been undertaken for each of the cutting blades 30, the pressure sleeve 24 is threaded to the blade body 26, thus locking the pivot pin retaining covers 38 in position. Disassembly is made by reversing each of these steps.

FIG. 5 is a perspective view of the mandrel 40 of the drilling apparatus 18. As noted above, the mandrel 40 includes external threads 41 which threadably mate with the internal threads 42 of the top sub 34. The external threads 41 are formed on the end of a shaft 62 which, at its distal end, includes a reduced diameter portion 64 having an O-ring 66. The proximal end of the shaft 62 includes a first smooth portion 68. The smooth portion terminates at a shoulder area 70 having an O-ring 72 positioned within a mating groove 73 thereupon. The first smooth portion 68, in combination with the shoulder area 70, forms the mandrel part of a fluid pressure chamber, to be further described below with respect to FIG. 6. (It should be noted that the O-rings are suggested and may be substituted with T-seals.)

On the side of the shoulder area 70 opposite the first smooth portion 68 is a second smooth portion 74 which terminates at a hex portion 76. The hex portion 76 terminates at a first triangular portion 78 which itself terminates at a recessed triangular portion 80. Between the first triangular portion 78 and the recessed triangular portion 80 is a first canted wall 81. The recessed triangular portion 80 terminates at a second triangular portion 82 which itself forms the terminal part of the mandrel 40, Between the recessed triangular portion 80 and the second triangular portion 82 is a second canted wall 83. The first triangular portion 78 is smaller than the second triangular portion 82. Finally, a third canted wall 85 is formed at the end of the mandrel 40.

Defined axially along the center of the mandrel 40 is a fluid channel 100 which is illustrated in FIGS. 6 and 9. The fluid channel is provided to deliver hydraulic fluid between the two opposite ends of the mandrel 40. Illustrated in FIG. 5 is a pilot bit hydraulic fluid outlet port 84 which feeds fluid into the fluid passageways 28 of the pilot bit 22 for lubrication. In addition to the pilot bit hydraulic fluid outlet port 84 are provided a pressure chamber radial port 86 which selectively delivers fluid to the pressure chamber as will be further described below and a series of cutting blade ports 88 (of which only one is shown) which selectively delivers lubricating and debris-clearing fluid to the cutting blades 30.

The cutting blade ports 88 enable fluid to be directed to and around the cutting blades 30, thus enabling both lubrication of the cutting surface 33 (similar to the lubricating features of a milling machine) and to clear the slots 32 thus preventing cuttings from jamming the cutting blades 30 in their extended positions. In this way, the cutting blade 30 may be retracted without being jammed by debris.

FIG. 6 is a partially-sectioned side view of the drilling apparatus 18 of the present invention illustrating the cutting blades 30 in their retracted positions. In addition, this figure is useful in its clear presentation of the relationship of the mandrel 40 to the top sub 34, the pressure sleeve 24, and the blade body 26 as well as to their miscellaneous attached elements.

Figure 7:
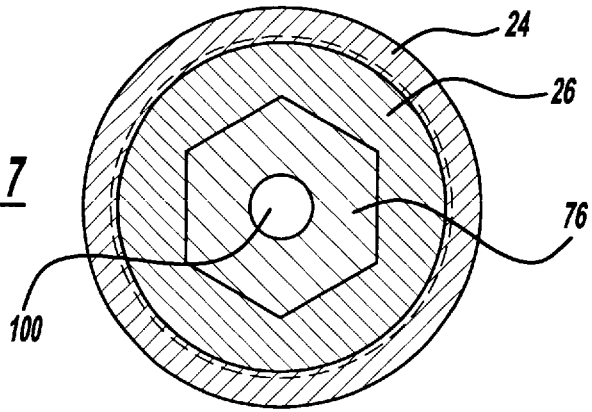
FIG. 7 is a view taken along line 7—7 of FIG. 6 which details the relationship between the mandrel and the pressure sleeve.

The hex portion 76 of the mandrel 40 allows for axial movement within the blade body 26. This arrangement is best illustrated in FIG. 7 which is taken along the line 7—7 of FIG. 6. As is shown, the interior surface of the blade body 36 is partially configured so as to substantially mate with the external hexagonal configuration of the hex portion 76. This arrangement not only provides a positive rotational lock between the mandrel 40 and the blade body 26, but also provides a method of allowing the entire drilling apparatus 18 to substantially absorb the torque produced during the drilling operation.

Figure 8:
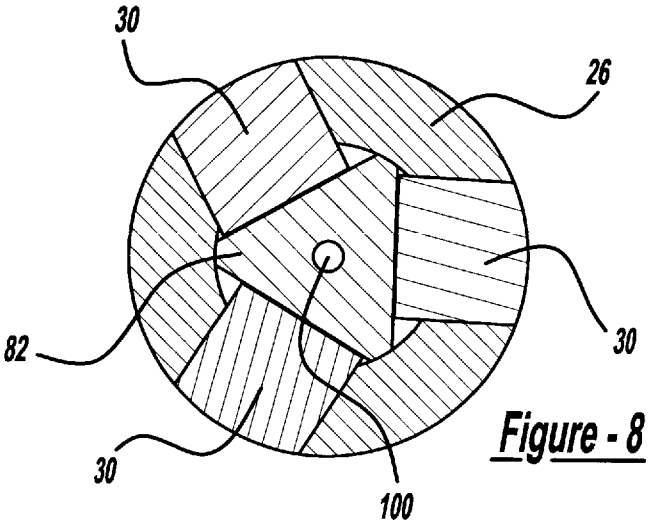
FIG. 8 is a view taken along line 8—8 of FIG. 6 which details the relationship between the mandrel, the blade body, and the cutting blades in their retracted positions.

FIG. 8 is a sectional view taken along lines 8—8 of FIG. 6 and shows the blades 30 in their retracted positions. In such a position, and as will be further discussed below, a portion of each of the blades 60 positively rest against the second triangular portion 82 while retracted.

With the configurations of FIGS. 7 and 8 as background, reference will be made back to FIG. 6 for a more complete understanding of the drilling apparatus 18 and its operation. FIG. 6 illustrates a spring chamber 90 formed substantially between the inner wall of the pressure sleeve 24 and the second smooth portion 74 of the mandrel 40. A spring 92 is provided within the spring chamber 90. One end of the spring rests against the shoulder area 70 of the mandrel 40 while the other end of the spring 92 positively engages and rests against one end of the blade body 26 to provide a biasing force therebetween. This biasing force maintains the drilling apparatus 18 in its hole insertion/withdrawal configuration in which the blades 30 are retracted.

As noted above, the fluid channel 100 is defined axially along the complete length of the mandrel 40 to provide fluid to the pilot bit hydraulic fluid outlet port 84 at one end of the mandrel as well as to the pressure chamber radial port 86 and to the cutting blade ports 88.

Figure 6A:
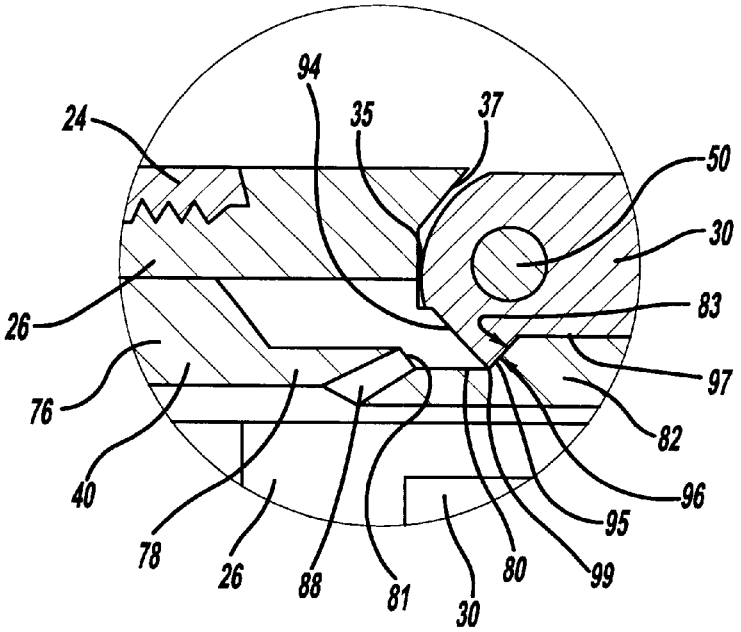
FIG. 6*a* is a view taken along line 6*a* of FIG. 6 which details the arrangement between the mandrel and the retracted cutting blade.

The relationship between the mandrel 40 and the cutting blades 30 is more clearly understood by reference to FIG. 6*a* which is a view taken along line 6*a* of FIG. 6. This figure details the arrangement between the mandrel 40 and one of the retracted cutting blades 30, although each of the remaining cutting blades 30 is formed with the same configuration and operates in an identical manner as the illustrated cutting blade 30. With reference to this exemplary cutting blade 30 (the remaining cutting blades 30 being configured in a like manner), the cutting blade 30 includes a first positive stop contact surface 93, a second position stop contact surface 95, a first flat surface 94, a second flat surface 96 adjacent to the first flat surface 94, a third flat surface 97 adjacent to the second flat surface 96, and a fourth flat surface 98 adjacent to the third flat surface 97. An edge 99 is formed at the junction of the first surface 94 and the second flat surface 96. Each of these features serves a function in the retraction and extension of the cutting blade 30.

As is illustrated in both FIGS. 6 and 6*a*, in its retracted position, the cutting blade 30, which is pivotably mounted on the pivot pin 50, rests substantially on the second triangular portion 82 of the mandrel 40. More specifically, the second flat surface 96 of the cutting blade 30 positively engages and rests against the second canted wall 83, while the third flat surface 97 positively engages and rests against an outer wall of the second triangular portion 82 to provide a substantially planar contact surface to allow the transfer of torsional force from the cutting blade 30 to the mandrel 40.

To be moved to its extended position, the mandrel 40 must be moved relative to the pressure sleeve 24 and the blade body 26. This movement effects rotation of each of the cutting blades 30 upon their pivot pins 50, thus causing extension of the cutting blades 30. However, the mandrel 40 is retained in its resting, cutting blade-retracted position of FIG. 6 by the biasing force of the spring 92. To overcome the biasing force of the spring 92 and to thereby effect movement of the mandrel 40 relative to the pressure sleeve 24 and the blade body 26, hydraulic fluid (not shown) must be introduced within the pressure sleeve 24 via the pressure chamber radial port 86. The hydraulic fluid is introduced into a variably-sized pressure chamber 102 which is between an O-ring 104 that is provided substantially within the pressure sleeve 24 and the O-ring 72 of the mandrel 40.

On introduction of sufficient fluid into the chamber 102, the biasing force of the spring 92 is eventually overcome and the mandrel 40 is axially moved to its cutting blade expanding position, as illustrated in FIG. 9. Details of the assembly are shown in FIG. 9*a*. While values vary depending on the conditions of the underreaming task involved, generally pressures above between about 150 to 200 p.s.i. are required to effect movement of the mandrel 40. (Pressures below these values still result in fluid flowing through the fluid channel 100 and out of the pilot bit hydraulic fluid outlet port 84 as well as out of the cutting blade ports 88.)

Figure 10:
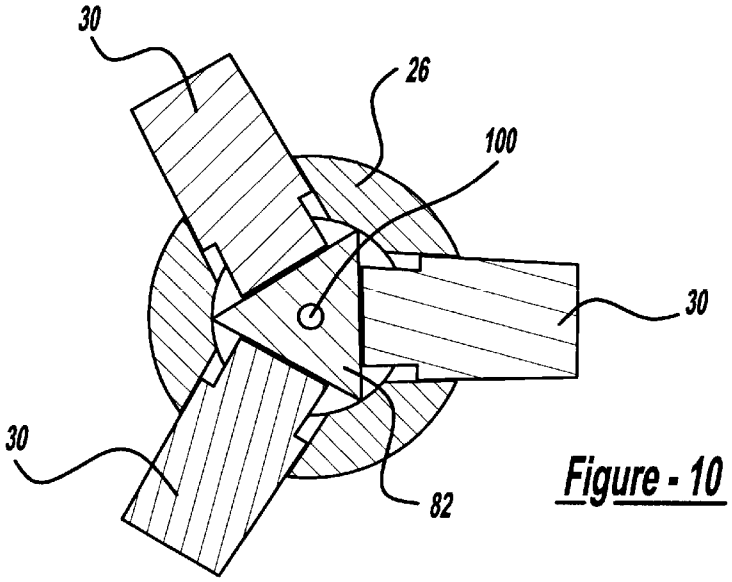
FIG. 10 is a view taken along line 10—10 of FIG. 10 which details the relationship between the mandrel, the blade body, and the cutting blades in their extended positions.

As the mandrel 40 is shifted from its cutting blade-retracted position of FIG. 6 to its cutting blade-extended position of FIG. 9, the third canted wall 85 of the mandrel 40 engages the fourth flat surface 98 of the cutting blade 30, initially urging the end of the cutting blade 33 having the cutting surface 33 formed thereon to be pivoted outward. As the mandrel 40 continues in its axial movement, the first canted wall 81 of the mandrel 40 engages the first surface 94 of the cutting blade 30, further urging the cutting surface 33 to be pivoted outward. The cutting blade 30 continues to be pivoted until the first surface 94 of the cutting blade 30 positively engages and rests against the flat portion of the first triangular portion 78 as the mandrel 40 moves to its maximum position as shown in FIG. 9. The fully extended position of the cutting blades 30 is illustrated in FIG. 10 which is a cross-section of the drilling apparatus 18 taken along lines 10—10 of FIG. 9. This arrangement provides for a planar contact surface that evenly transfers torsional forces from the cutting blades 30 to the mandrel 40.

The cutting blade 30 achieves a positive stop in its extended position through three surface-to-surface contacts between the portions of the blade 30, the blade body 26, and the mandrel 26. These stop arrangements are illustrated clearly in FIG. 9*a*. When extended, the first positive stop contact surface 93 and the second positive stop contact surface 95 of the blade 30 abuts the cutting blade stop edges 35 and 37 of the blade body 26, respectively. This forms two positive stops. The other positive stop is formed between the planar surface of the first triangular portion 78 of the mandrel 40 and the first flat surface 94 of the cutting blade 30. By these features a positive lock is achieved and the risk of damaging the operative elements (such risk being well-known in the gear tooth designs of the prior art) is significantly reduced if not eliminated. In this regard, the tortional force from the extended cutting blades 30 is absorbed by both the mandrel 40 and the blade body 26 and transferred to the entire underreaming assembly 18. Therefore, tortional force is not merely concentrated at the connection point of the cutting blades 30.

Retraction of the blades 30 to their resting positions shown in FIG. 6 is enabled by release of the fluid pressure from the fluid chamber 102. As the spring 92 acts to return the mandrel 40 to its cutting blade-retracted position, the edge 99 formed at the junction of the first surface 94 and the second flat surface 96, is acted upon by the second canted wall 83 of the mandrel 40. (It is to be recalled that the first triangular portion 78 of the mandrel is smaller than the second triangular portion 82.) This movement initiates inward pivoting of the cutting blade 30 at the end defined by the cutting surface 33 which, as the edge 99 slides inwardly (relative to the mandrel 40) along the second canted wall 83, is completed when the second flat surface 96 positively engages and rests upon the second canted wall 83 and the third flat surface 97 positively engages and rests upon a flat surface of the second triangular portion 82.

Preferably each of the metal components of the present invention would be composed of case-hardened steel.

The present invention provides a drilling apparatus which is simple in construction and is easily disassembled and reassembled. The drilling apparatus of the present invention allows for easy changing of the cutting blades, prevents shearing of the cutting blades, and resists invasion by debris.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An underreaming tool comprising:

a substantially hollow tubular body having at least one pivot pin bore and at least one pivot pin retaining cover slot formed therein, said at least one pivot pin bore located within said at least one pivot pin retaining cover slot;

a mandrel mounted substantially within said hollow tubular body, said mandrel being axially movable between a blade retracting position and a blade extending position;

at least one cutting blade pivotably mounted to said hollow tubular body, said at least one cutting blade being operatively associated with said mandrel for selective retraction and extension with respect to said substantially hollow tubular body, said cutting blade having a pivot pin bore formed therein;

a pivot pin slidably insertable into said at least one pivot pin bore of said hollow tubular body and said pivot pin bore of said cutting blade for pivotably attaching said at least one cutting blade to said substantially hollow tubular body; and a pivot pin retaining cover operable to be received in said at least one pivot pin retaining cover slot to cover an end of said pivot pin.

2. The underreaming tool of claim 1, wherein said substantially hollow tubular body comprises a pressure sleeve and a blade body, said at least one cutting blade being pivotably attached to said blade body.

3. The underreaming tool of claim 2, wherein said pivot pin retaining cover is selectively movable between a pin covering position and a pin exposing position, said pivot pin retaining cover being retained in its pin covering position by said pressure sleeve.

4. The underreaming tool of claim 2, wherein said pressure sleeve includes an interior wall having a first sealing member and wherein said mandrel includes a pressure portion partially defined by a second sealing member, said tool further including a fluid pressure chamber formed between said first sealing member of said interior wall of said pressure sleeve and said second sealing member of said pressure portion of said mandrel.

5. The underreaming tool of claim 1, wherein said pivot pin retaining cover is slidably positionable within said pivot pin retaining cover slot.

6. The underreaming tool of claim 5, further including two adjacent cutting blades and two adjacent pivot pins, said pivot pin retaining cover simultaneously retaining said two adjacent pivot pins.

7. The underreaming tool of claim 1, wherein said substantially hollow tubular body comprises a pressure sleeve and a blade body, said mandrel having a plurality of flat axial surfaces and said blade body having an interior wall defined by a plurality of flat axial surfaces, said flat axial surfaces of said mandrel being substantially matable with said flat axial surfaces of said interior wall of said blade body, whereby the torsional force produced by the at least one cutting blade is substantially dissipated between said mandrel and said blade body.

8. The underreaming tool of claim 7, wherein said flat axial surfaces of said mandrel and said flat axial surfaces of said interior wall of said blade body define a hexagon in cross-section.

9. An underreaming tool comprising:

a substantially hollow tubular body having at least one pivot pin bore and a pivot pin retaining cover slot formed therein, said at least one pivot pin bore located within said at least one pivot pin retaining cover slot;

a mandrel mounted substantially within said hollow tubular body, said mandrel being axially movable between a blade retracting position and a blade extending position;

at least one cutting blade pivotably mounted to said hollow tubular body, said at least one cutting blade being operatively associated with said mandrel for selective retraction and extension with respect to said substantially hollow tubular body;

a pivot pin for pivotably holding said cutting blade to said hollow tubular body and insertable into said at least one pivot pin bore; and a pivot pin retaining cover for retaining said pivot pin, said pivot pin cover being slidably positionable within said pivot pin retaining cover slot, said pivot pin retaining cover having a pair of angled opposed walls that slidably mate with a pair of angled opposed walls of said pivot pin retaining cover slot.

10. The underreaming tool of claim 9, wherein said cutting blade defines a pivot pin bore formed therein, said pivot pin being slidably insertable into said at least one pivot pin bore of said tubular body and said pivot pin bore of said cutting blade for pivotably retaining said at least one cutting blade.

11. The underreaming tool of claim 9, further including two adjacent cutting blades and two adjacent pivot pins, wherein said pivot pin retaining cover simultaneously retains said two adjacent pivot pins.

12. The underreaming tool of claim 9, wherein said substantially hollow tubular body further including a pressure sleeve and said pivot pin retaining cover is selectively movable between a pin covering position and a pin exposing position, said pivot pin retaining cover being retained in its pin covering position by said pressure sleeve.

13. The underreaming tool of claim 9, wherein said mandrel includes a plurality of flat axial surfaces and said tubular body having an interior wall defined by a plurality of flat axial surfaces, said flat axial surfaces of said mandrel being substantially matable with said flat axial surfaces of said interior wall of said tubular body, whereby the torsional force produced by the at least one cutting blade is substantially dissipated between said mandrel and said tubular body.

14. The underreaming tool of claim 13, wherein said flat axial surfaces of said mandrel and said flat axial surfaces of said interior wall of said tubular body define a hexagon in cross-section.

15. An underreaming tool comprising:

a substantially hollow tubular body having a cutting blade fastener retaining cover slot and a pressure sleeve;

a mandrel mounted substantially within said hollow tubular body, said mandrel being axially movable between a blade retracting position and a blade extending position;

at least one cutting blade pivotably mounted to said hollow tubular body said at least one cutting blade being operatively associated with said mandrel for selective retraction and extension with respect to said substantially hollow tubular body;

a cutting blade fastener for pivotably holding said cutting blade to said blade body; and a cutting blade fastener retaining cover for retaining said cutting blade fastener, said cutting blade fastener cover being slidably positionable within said cutting blade fastener retaining cover slot, wherein said retaining cover has a pressure sleeve engaging edge which engages said pressure sleeve to produce a press fit of said retaining cover when said cover is in said cutting blade fastener retaining cover slot.

16. The underreaming tool of claim 15, wherein said pressure sleeve includes an interior wall having e first sealing member and wherein said mandrel includes a pressure portion partially defined by a second sealing member, said tool further including a fluid pressure chamber formed bet ween said first sealing member of said interior wall of said pressure sleeve and said second sealing member of said pressure portion of said mandrel.

17. An underreaming tool comprising:

a substantially hollow tubular body including a blade body having an interior wall defined by at least one substantially planar surface;

a mandrel mounted substantially within said hollow tubular body, said mandrel being axially movable between a blade retracting position and a blade extending position, said mandrel including a first substantially planar surface and a second substantially planar surface, said first substantially planar surface of said mandrel being substantially matable with said at least one substantially planar surface of said interior wall of said blade body; and at least one cutting blade pivotably connected relative to said blade body and having at least one substantially planar surface, said at least one substantially planar surface of said at least one cutting blade being substantially matable with said second substantially planar surface of said mandrel for selective retraction and extension, whereby the torsional force produced by said at least one cutting blade is absorbed by said mandrel and said blade body, whereby said torsional force is not concentrated at the pivotable connection point of said at least one cutting blade.

18. The underreaming tool of claim 17, wherein said interior wall of said blade body is formed by a plurality of substantially planar surfaces and said mandrel is formed by a plurality of substantially planar surfaces that define a hexagon in cross-section.

19. An underreaming tool comprising:

a tubular body, said tubular body includes a pressure sleeve, said pressure sleeve including an interior wall;

a mandrel mounted in said tubular body, said mandrel being axially extendable and including a pressure chamber wall; and a dynamic pressure chamber defined by said tubular body and said mandrel operable to actuate said mandrel from a first position to a second position upon achieving a predetermined fluid pressure buildup within said dynamic pressure chamber, said dynamic pressure chamber formed between a first pressure chamber sealing member fixedly secured within said interior wall of said pressure sleeve to engage said pressure chamber wall of said mandrel and a second pressure chamber sealing member secured about said mandrel to movably engage said interior wall of said pressure sleeve.

20. An underreaming tool comprising:

a substantially hollow tubular body defining a recessed pivot pin retaining cover slot, said substantially tubular body further defining a first pivot pin bore and a second pivot pin bore each located within said recessed pivot pin retaining cover slot;

a mandrel mounted substantially within said hollow tubular body, said mandrel being axially movable between a blade retracting position and a blade extending position;

a first cutting blade pivotably mounted to said hollow tubular body with a first pivot pin that is slidably insertable into said first pivot bore;

a second cutting blade pivotably mounted to said hollow tubular body with a second pivot pin that is slidably insertable into said second pivot bore; and a pivot pin retaining cover operable to be received in said pivot pin retaining cover slot to simultaneously retain said first and second pivot pins.

21. The underreaming tool of claim 20 further comprising a biasing mechanism operated to bias said mandrel to the blade retracting position.

22. The underreaming tool of claim 21, wherein said biasing mechanism comprises an axial spring.

23. The underreaming tool of claim 22, further comprising a dynamic fluid pressure chamber operable to oppose the biasing force produced by said biasing mechanism upon receiving a predetermined fluid pressure.

24. An underreaming tool comprising:

a substantially hollow tubular body having at least one pivot pin bore and at least one pivot pin retaining cover slot formed therein, said at least one pivot pin bore located within said at least one pivot pin retaining cover slot;

a mandrel mounted substantially within said hollow tubular body, said mandrel being axially movable between a blade retracting position and a blade extending position;

at least one cutting blade pivotably mounted to said hollow tubular body for selective retraction and extension with respect to said substantially hollow tubular body, said cutting blade having a pivot pin bore formed therein;

a pivot pin having a first end and a second end that is slidably insertable into said at least one pivot pin bore of said hollow tubular body and said pivot pin bore of said cutting blade for pivotably attaching said at least one cutting blade to said substantially hollow tubular body, said first end and said second end of said pivot pin being beveled, such that once said pivot pin Is slidably inserted into said hollow tubular body, at least one beveled end of said pivot pin is flush with said pivot pin retaining cover slot; and a pivot pin retaining cover operable to be received in said at least one pivot pin cover slot to cover said at least one beveled end of said pivot pin.

25. The underreaming tool of claim 24 wherein said mandrel includes at least one planar surface and said at least one cutting blade includes at least one planar surface, said planar surface of said mandrel substantially mating with said at least one planar surface of said cutting blade to define a positive engaged position.

26. The underreaming tool of claim 25, wherein said at least one planar surface of said at least one cutting blade is a first planar cutting blade contact surface and said planar surface of said mandrel is a first planar mandrel surface, said first surfaces being matable so as to define a positive stop for said cutting blade when in said retracted position.

27. The underreaming tool of claim 26, wherein said at least one planar surface of said at least one cutting blade includes a second planar cutting blade contact surface and said planar surface of said mandrel includes a second planar mandrel surface, said second surfaces being matable so as to define a positive stop for said cutting blade when in said extended position.

28. The underreaming tool of claim 25, wherein said tubular body includes a first stop surface and a second stop surface and said at least one cutting blade includes a first mating stop surface and a second mating stop surface, whereby when said cutting blade is in said extended position said first and second surfaces engage to provide a positive stop.

* * * * *

UNITED STATES PATENT AND TRADEMARK OFFICE

CERTIFICATE OF CORRECTION

PATENT NO. : 6,427,788 B1
DATED : August 6, 2002
INVENTOR(S) : William D. Rauchenstein It is certified that error appears in the above-identified patent and that said Letters Patent is hereby corrected as shown below:

Column 5,
Line 52, after "40" insert -- . --.

Column 7,
Line 23, "40," should be -- 40. --.

Column 12,
Line 17, "e" should be -- a --.
Line 21, "bet ween" should be -- between --.

Column 14,
Line 10, "Is" should be -- is --.

Signed and Sealed this

Thirtieth Day of September, 2003

JAMES E. ROGAN
*Director of the United States Patent and Trademark Office*